US007105756B1

(12) United States Patent
Plaschkes

(10) Patent No.: US 7,105,756 B1
(45) Date of Patent: Sep. 12, 2006

(54) FLOWSWITCH HAVING REDUCED NUMBER OF PARTS

(75) Inventor: Michael Plaschkes, Magen (IL)

(73) Assignee: Plastic Magen, LP, Magen (IL)

( * ) Notice: Subject to any disclaimer, the term of this patent is extended or adjusted under 35 U.S.C. 154(b) by 0 days.

(21) Appl. No.: 11/162,743

(22) Filed: Sep. 21, 2005

(51) Int. Cl.
*H01H 35/40* (2006.01)

(52) U.S. Cl. ..... 200/81.9 M

(58) Field of Classification Search ..... 200/81 R, 200/81.9 R, 81.9 M; 73/861.74, 861.75, 73/861.77; 307/118; 335/205–207
See application file for complete search history.

(56) References Cited

U.S. PATENT DOCUMENTS

| | | | | |
|---|---|---|---|---|
| 3,148,254 | A * | 9/1964 | Clason | 200/81.9 R |
| 3,251,335 | A | 5/1966 | Dannevik | |
| 3,359,385 | A | 12/1967 | Bentz et al. | |
| 3,569,648 | A | 3/1971 | De Meyer | |
| 3,749,864 | A | 7/1973 | Tice | |
| 4,085,336 | A * | 4/1978 | Miles | 200/81.9 M |
| 4,282,413 | A | 8/1981 | Simons et al. | |
| 4,596,442 | A | 6/1986 | Anderson et al. | |
| 4,614,122 | A | 9/1986 | Graves | |
| 4,827,092 | A * | 5/1989 | Kobold | 200/81.9 M |
| 4,906,807 | A | 3/1990 | Siebert et al. | |
| 4,963,857 | A * | 10/1990 | Sackett | 200/81.9 M |
| 5,091,612 | A | 2/1992 | Van Fossen | |
| 5,126,097 | A | 6/1992 | Weng et al. | |
| 5,183,983 | A * | 2/1993 | Knop | 200/81.9 M |
| 5,691,484 | A | 11/1997 | Feller | |
| 6,212,958 | B1 | 4/2001 | Conley | |
| 6,548,775 | B1 | 4/2003 | Edwards | |
| 6,819,292 | B1 | 11/2004 | Winter | |
| 2005/0028609 | A1 | 2/2005 | Langemann et al. | |

FOREIGN PATENT DOCUMENTS

| | | |
|---|---|---|
| DE | 33 17 923 A1 | 11/1983 |
| WO | WO 93/01606 | 1/1993 |

* cited by examiner

*Primary Examiner*—Michael A. Friedhofer
(74) *Attorney, Agent, or Firm*—Ronald E. Smith; Smith & Hopen, P.A.

(57) ABSTRACT

A flow switch includes a straight, rigid paddle arm and a hub formed mid-length of the paddle arm. An elongate cylindrical member and an elongate paddle handle are formed integrally with the hub and extend from the hub in opposite radial directions. A cylindrical magnet is disposed within a hollow interior of the cylindrical member. A flat paddle is formed integrally with the elongate paddle handle at a radially outermost end of the paddle handle. A transparent top housing houses a flat magnet that attracts the cylindrical magnet and causes the paddle arm to pivot into a position of repose. The cylindrical magnet pivots away from the position of repose into close proximity with a reed switch when the strength of the fluid flow exceeds the magnetic attraction. The reed switch is housed in the top housing in diametrically opposed relation to the flat magnet.

11 Claims, 2 Drawing Sheets

FLOWSWITCH HAVING REDUCED NUMBER OF PARTS

FIELD OF THE INVENTION

This invention relates, generally, to flowswitches. More particularly, it relates to a flowswitch construction having a small number of parts.

DESCRIPTION OF THE PRIOR ART

Conventional flowswitches are typically of complex construction, including a large number of parts. Accordingly, they are difficult to maintain and they are prone to malfunction. More particularly, conventional flowswitches include a pivotally mounted paddle that extends into a liquid fluid. In one common arrangement, a reed switch has a fixed position that is unaffected by liquid flow. When the paddle pivots in response to fluid flow, a magnet carried by the paddle pivots into a position near the reed switch, thereby activating the reed switch, closing a circuit, and generating a signal indicating said fluid flow.

A reed switch typically includes two or three flexible and resilient metal reeds having electrical contacts at a first end thereof. The reeds are encapsulated in a sealed glass tube. Where only two reeds are provided, the reeds are positioned in a normally open (NO) relation to one another, thereby providing an open switch. The presence of a magnetic field brings the two electrodes together, closing the switch. The resiliency of the reeds opens the switch again as soon as the magnetic field is removed. A three reed switch includes a pair of normally open (NO) and a pair of normally closed (NC) contacts. Both pairs change to the opposite state in the presence of a magnetic field and return to their respective positions of repose when the magnetic field is removed. The magnet must therefore pass very close (1 cm or less) to the reed switch.

The known flowswitches have complex constructions. Accordingly, they are not durable. What is needed, then, is a flowswitch having a simple, elegant structure that is not susceptible to easy breakage or jamming.

However, in view of the prior art considered as a whole at the time the present invention was made, it was not obvious to those of ordinary skill in the pertinent art how the identified need could be fulfilled.

SUMMARY OF THE INVENTION

The long-standing but heretofore unfulfilled need for a flowswitch having an elegant, simplified construction is now met by a new, useful, and nonobvious invention. The novel flowswitch includes a paddle arm having a rigid, elongate construction and a straight configuration. A hub is formed substantially mid-length of the paddle arm. An elongate cylindrical member is formed integrally with the hub and extends therefrom in a first radial direction. An elongate paddle handle is also formed integrally with the hub and extends therefrom in a second radial direction. The second radial direction is opposite to the first radial direction so that the elongate cylindrical member, the hub, and the paddle handle collectively form the straight paddle arm.

A cylindrical magnet is disposed within a hollow interior of the cylindrical member and is encased within a hollow interior of the cylindrical member by epoxy.

A bore is formed in the hub and has an axis that is normal to an elongate axis of the paddle arm and an elongate axis of the elongate cylindrical member and the paddle handle. A pin is disposed within the bore so that the paddle arm may pivot about said pin.

A flat paddle is formed integrally with the elongate paddle handle at a radially outermost end thereof. The flat paddle is oriented in a plane transverse to the flow of fluid in a conduit. The pressure of the fluid flow acting against the flat paddle surface causes the paddle arm to pivot about the pin that extends through the hub of the paddle arm.

A transparent, translucent, or opaque top housing has a first end and a reduced diameter second end that are formed integrally with one another. An annular shoulder is formed where the first end and the reduced diameter second end of the top housing meet one another. The top housing has fluted sidewalls.

A first slot is formed in the first end of the top housing, intermediate a pair of flutes. The first slot has an open end in open communication with the annular shoulder, and accommodates a flat magnet. A second slot is also formed in the top housing, in diametrically opposed relation to the first slot. The second slot has an open end in open communication with the annular shoulder as well and is also positioned between a pair of flutes. The second slot accommodates a reed switch.

A bottom housing has a first end adapted to slidingly receive the reduced diameter second end of the top housing. The bottom housing has a flat, annular leading end that abuts the annular shoulder of the top housing to close the respective open ends of the first and second slots.

The bottom housing further includes a second, screwthreaded end adapted to engage complemental screwthreads formed in a conduit through which a fluid may flow. The bottom housing also includes a tool-engageable middle part disposed between the first end and the screwthreaded end.

The reduced diameter end of the top housing is adhered to the first end of the bottom housing to provide a hermetic seal that protects the flat magnet and the reed switch.

The flat magnet has a polarity opposite to a polarity of the cylindrical magnet so that the magnets attract one another, thereby causing the paddle arm to pivot into a position of repose where the cylindrical magnet is diametrically spaced apart from the reed switch. The paddle arm remains in its position of repose when a fluid flow-imparted force impinging upon the paddle is less than the magnetic force between the flat magnet and the cylindrical magnet. The reed switch thus remains in its normally open state and no signal is sent.

The cylindrical magnet pivots into close proximity to the reed switch when the paddle is pivoted away from its position or repose by fluid flowing through the conduit. The strength of the fluid flow must exceed the strength of the magnetic attraction between the cylindrical and flat magnets. This causes the reed switch to close, thereby closing a circuit so that a signal indicating fluid flow is sent.

An important object of this invention is to provide a flowswitch having an irreducibly small number of parts.

A closely related object is to provide a flowswitch that is durable over time.

Another object is to provide a flowswitch having transparency so that debris therewithin can be seen and removed.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
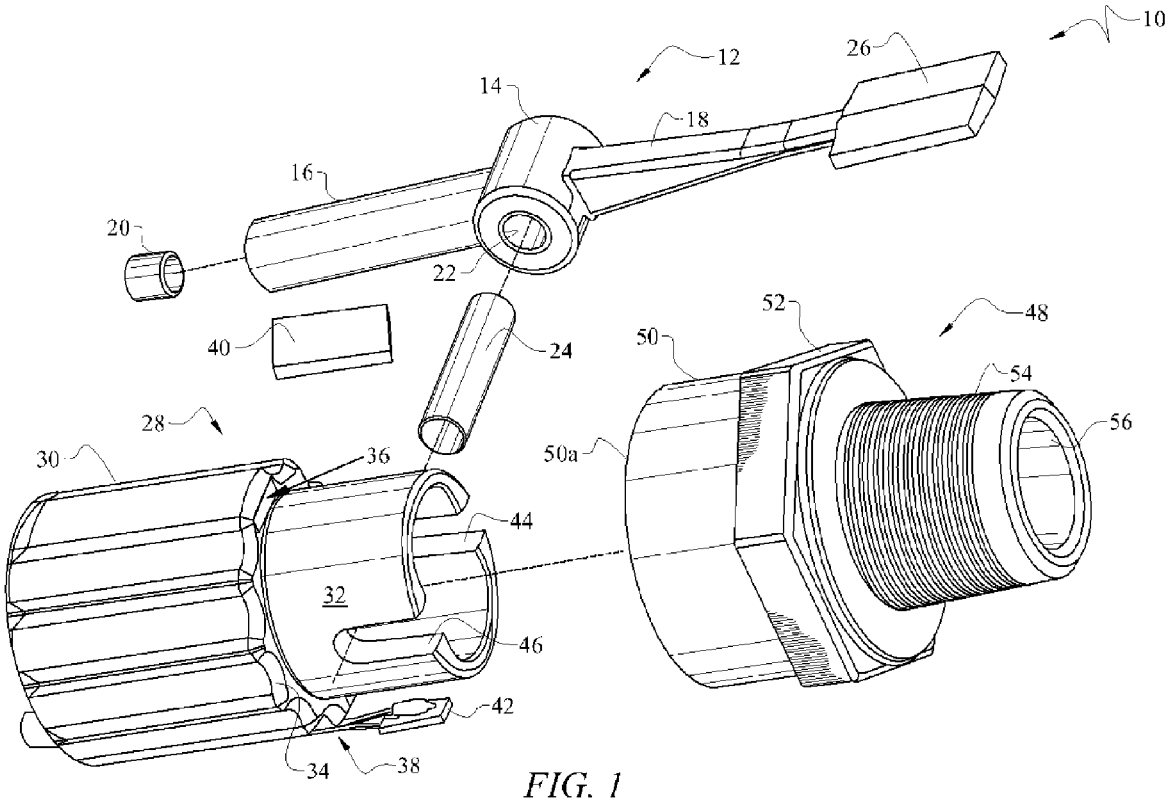
FIG. 1 is an exploded perspective assembly view of the novel flowswitch.
Figure 3:
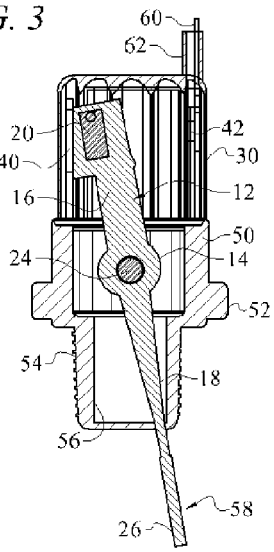
FIG. 3 is a longitudinal sectional view of the structure depicted in FIG. 2A from a first side thereof.
Figure 4:
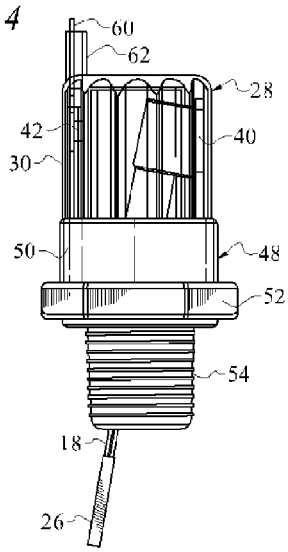
FIG. 4 is a side elevational view of the structure depicted in FIG. 2A from a second side thereof.

Referring now to FIG. 1, it will there be seen that the novel assembly in exploded view is denoted as a whole by the reference numeral 10.

Assembly 10 includes a paddle arm 12 having a rigid, elongate construction and a straight configuration. Hub 14 is formed substantially mid-length of paddle arm 12. Elongate cylindrical member 16 is formed integrally with hub 14 and extends therefrom in a first radial direction.

An elongate paddle handle 18 is formed integrally with hub 14 and extends radially from said hub 14 in a second direction opposite to said first direction so that elongate cylindrical member 16, hub 14, and paddle handle 18 collectively form straight paddle arm 12.

Cylindrical magnet 20 is disposed within a hollow interior of cylindrical member 16 and is encased in epoxy. The epoxy holds magnet 20 into position so that it does not slide within the hollow interior of cylindrical member 16. The cylindrical shape of member 16 is not critical nor must magnet 20 have a cylindrical shape.

Bore 22 is formed in hub 14. Bore 22 has an axis normal to an elongate axis of paddle arm 12. Pivot pin 24 is disposed within bore 22.

Substantially flat paddle 26 is formed integrally with elongate paddle handle 18 at a radially outermost end of said elongate paddle handle. Substantially flat paddle 26 is oriented in a plane transverse to a flow of liquid through a conduit when the novel flowswitch is in use.

Top housing 28 is hollow and has a first end 30 and a reduced diameter second end 32 formed integrally with first end 30. Annular shoulder 34 is formed where first end 30 and reduced diameter second end 32 meet.

At least two slots 36 and 38 are formed in first end 30, both of said slots having an open end in open communication with annular shoulder 34. Flat magnet 40 is slideably received within first slot 36 and reed switch 42 is slideably received within second slot 38. First and second slots 36 and 38 are diametrically opposed with respect to one another. Flat magnet 40 and reed switch 42 are therefore diametrically opposed to one another.

Two diametrically opposed elongate slots 44 and 46 are formed in reduced diameter second end 32. Slots 44 and 46 are spaced ninety degrees (90°) from slots 36, 38 as best understood when top housing 28 is viewed in end view. Slots 44 and 46 slidingly receive opposite ends of pin 24 when the novel parts are in assembled relation to one another.

Bottom housing 48 includes a first end that includes first cylindrical part 50, a middle section that includes tool-engageable part 52, and a second end that includes externally screwthreaded neck 54. Bore 56 is formed in said bottom housing to accommodate paddle handle 18. Neck 54 is adapted to engage a conduit through which a fluid flows. Any suitable engagement means may be used; the screwthreads are not a critical part of this invention.

When the novel parts are in their assembled relation to one another, reduced diameter second end 32 of top housing 28 is slideably received within first cylindrical part 50 of bottom housing 48. The open ends of slots 36 and 38 are disposed in abutting relation to annular flat leading end 50*a* of first cylindrical part 50 of bottom housing 48, thereby enclosing flat magnet 40 within slot 36 and reed switch 42 within slot 38. Elongate cylindrical member 16 and hence cylindrical magnet 20 are positioned within the hollow interior of first end 30 of top housing 28 and substantially flat paddle 26 extends radially outwardly of bore 56.

Such assembled configuration is better understood in connection with FIGS. 2A, 2B, 3 and 4. In those views, paddle arm 12 is pivoted counterclockwise about pin 24 relative to an upright position under the magnetic attraction of magnet 20, hereinafter sometimes referred to as the first magnet, and flat magnet 40 of opposite polarity, hereinafter sometimes referred to as the second magnet. Thus it is understood that said first and second magnets bias paddle arm 12 into its depicted position when no fluid is flowing in the direction indicated by directional arrow 58 and when the strength of the fluid flow is insufficient to overcome said magnetic attraction. Accordingly, cylindrical or first magnet 20 is positioned a maximum distance away from reed switch 42 so that said normally open reed switch remains open. When the strength of fluid flow 58 bearing against paddle 26 is sufficient to overcome the magnetic attraction between said first and second magnets 20 and 40, paddle arm 12 pivots clockwise from its FIG. 3 position and first magnet 20 approaches closely to reed switch 42, thereby causing said reed switch to close and to thereby complete a circuit that sends a signal indicating that the fluid flow has reached a minimum threshold. The signal is carried by conductor 60 that is protected by boss means 62 as its point of exit from top housing 28. When the strength of the fluid flow is less than the strength of the magnetic attraction between magnets 20 and 40, paddle arm 12 again pivots to or at least towards its FIG. 3 position and reed switch 42 returns to its normally open configuration, thereby opening the circuit so that no signal indicating fluid flow is transmitted.

Advantageously, top housing 28 is formed of a transparent material as above-mentioned so that any debris therein is visible. This facilitates maintenance of the flowswitch.

Figure 2A:
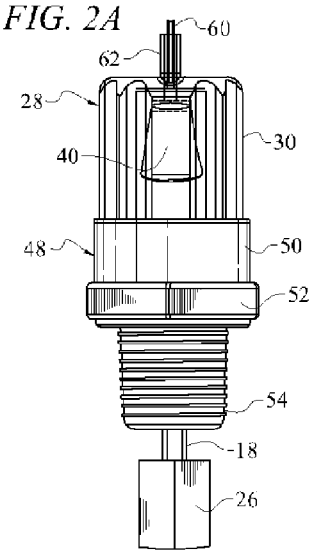
FIG. 2A is a front elevational view of the novel flowswitch when in its assembled configuration.
Figure 2B:
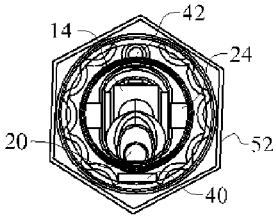
FIG. 2B is a top plan view of the structure depicted in FIG. 2A.

Moreover, the fluted structure of top housing 28 provides a convenient means for holding flat magnet 40 and reed switch 42 into their respective positions, as best understood in connection with FIG. 2B. Magnet 40 is positioned between and held into position by a pair of circumferentially spaced apart flutes, as is reed switch 42. The fluted structure is aesthetically-pleasing and also provides a good grip to facilitate the screwthreaded engagement of the flow switch into the "T" in the pipe configuration.

The paddle size may be adjusted to adjust the flow rate, as indicated in the following test results. For flow calibration purposes, the flowswitch was mounted in a two inch (2") "T" (Sanideng® during a first test and Dura® during a second test). Flow was measured with an electric flow-meter. The stabilization time allowed was two (2) minutes per setting. The flow measurement is a mean value of five (5) measurements. The following results are for the Sanideng® "T."

| L = PADDLE LENGTH | FLOW FOR CONTACT ON | | |
|---|---|---|---|
| 43 mm | 70 l/min | 18.0 gpm | 4200 l/h |
| 38 mm | 76 l/min | 20.0 gpm | 4560 l/h |
| 30 mm | 92 l/min | 24.3 gpm | 5520 l/h |
| 25 mm | 13 l/min | 29.8 gpm | 6780 l/h |
| **L = PADDLE LENGTH** | **FLOW FOR CONTACT OFF** | | |
| 43 mm | 35 l/min | 9.2 gpm | 21000 l/h |
| 38 mm | 42 l/min | 11.0 gpm | 2520 l/h |
| 30 mm | 45 l/min | 11.9 gpm | 2700 l/h |
| 25 mm | 52 l/min | 13.7 gpm | 3120 l/h |

The values were twelve percent (12%) higher when using Dura® "T."

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A flow switch, comprising:

a paddle arm having a rigid, elongate construction and a straight configuration;

a hub formed substantially mid-length of said paddle arm;

a first elongate member formed integrally with said hub and extending from said hub in a first radial direction, said first elongate member having a hollow interior;

a second elongate member formed integrally with said hub and extending from said hub in a second radial direction opposite to said first radial direction so that said first and second elongate members and said hub collectively form said paddle arm of straight configuration;

a first magnet disposed within said hollow interior of said first elongate member;

said hub being mounted for pivotal movement;

a flat paddle formed integrally with said second elongate member at a radially outermost end thereof;

said flat paddle adapted to be immersed in a liquid fluid, said flat paddle oriented in a plane transverse to a flow of said liquid fluid when said liquid fluid is contained within a conduit;

a top housing;

said top housing adapted to house a second magnet and a reed switch in diametrically opposed relation to one another;

a bottom housing having a first end adapted to engage said top housing;

said bottom housing also having a second end, said second end adapted to engage the conduit through which the fluid may flow;

said first magnet pivoting into close proximity to said reed switch when said paddle is pivoted away from a position of repose by the fluid flowing through said conduit;

said second magnet having a polarity opposite to a polarity of said first magnet so that said first and second magnets attract one another and so that said magnetic attraction causes the first magnet to pivot away from the reed switch when a fluid flow-imparted force impinging upon said paddle is less than a magnetic force between said first and second magnets.

2. The flow switch of claim 1, further comprising:

said top housing being formed of a transparent material.

3. The flow switch of claim 1, further comprising:

said top housing formed of an opaque material.

4. The flow switch of claim 1, further comprising:

said first elongate arm having a cylindrical configuration; and said first magnet having a cylindrical configuration.

5. The flow switch of claim 1, further comprising:

said second magnet having a flat configuration.

6. The flow switch of claim 1, further comprising:

said top housing having a fluted construction;

said reed switch being disposed between a first pair of circumferentially spaced apart flutes; and said second magnet being disposed between a second pair of circumferentially spaced apart flutes.

7. The flowswitch of claim 6, further comprising:

said top housing having a first end and a reduced diameter second end formed integrally with one another;

an annular shoulder formed where said first end and said reduced diameter second end of said top housing meet;

a first slot and a second slot formed in said first end;

said first slot and said second slot each having an open end flush with said annular shoulder;

said first slot accommodating said second magnet and said second slot accommodating said reed switch;

said first slot defined by said first pair of circumferentially spaced apart flutes; and said second slot defined by said second pair of circumferentially spaced apart flutes.

8. The flowswitch of claim 7, further comprising:

a bottom housing having a first end adapted to slidingly receive the reduced diameter second end of said top housing; and said bottom housing having a flat, annular leading end that abuts said annular shoulder of said top housing to close said respective open ends of said first and second slots.

9. The flowswitch of claim 8, further comprising:

said bottom housing having a second, screwthreaded end adapted to engage complemental screwthreads formed in the conduit through which the fluid may flow; and said bottom housing having a tool-engageable middle part disposed between said first end and said second, screwthreaded end.

10. The flowswitch of claim 9, further comprising:

said reduced diameter second end of said top housing being adhered to said first end of said bottom housing to provide a hermetic seal that protects said cylindrical magnet and said flat magnet.

11. A flow switch, comprising:

a paddle arm having a rigid, elongate construction and a straight configuration;

a hub formed substantially mid-length of said paddle arm;

an elongate cylindrical member formed integrally with said hub and extending from said hub in a first radial direction;

an elongate paddle handle formed integrally with said hub and extending from said hub in a second radial direction, said second radial direction being opposite to said first radial direction so that said elongate cylindrical member, said hub, and said paddle handle collectively form said paddle arm of straight configuration;

a cylindrical magnet disposed within a hollow interior of said elongate cylindrical member;

said hub having a bore formed therein, said bore having an axis normal to a longitudinal axis of said paddle handle;

a pivot pin disposed within said bore;

a flat paddle formed integrally with said elongate paddle handle at a radially outermost end of said elongate paddle handle;

said flat paddle oriented in a plane transverse to a flow of liquid fluid;

a top housing having a first end and a reduced diameter second end formed integrally with said first end;

an annular shoulder formed where said first end and said reduced diameter second end of said top housing meet;

a first slot and a second slot formed in said first end;

said first slot and said second slot each having an open end flush with said annular shoulder;

a flat magnet slidingly received within said first slot;

a reed switch slidingly received within said second slot;

said first and second slots being diametrically opposed to one another;

a bottom housing having a first end adapted to slidingly receive the reduced diameter second end of said top housing;

said bottom housing having a flat, annular leading end that abuts said annular shoulder of said top housing to close said respective open ends of said first and second slots;

said bottom housing having a second, screwthreaded end adapted to engage complemental screwthreads formed in a conduit through which the fluid may flow;

said bottom housing having a tool-engageable middle part disposed between said first end and said screwthreaded end;

said reduced diameter end of said top housing being adhered to said first end of said bottom housing to provide a hermetic seal that protects said cylindrical magnet and said flat magnet;

said cylindrical magnet pivoting into close proximity to said reed switch when said paddle is pivoted away from a position of repose by the fluid flowing through said conduit;

said flat magnet having a polarity opposite to a polarity of said cylindrical magnet so that said flat magnet and said cylindrical magnet attract one another so that the cylindrical magnet pivots away from the reed switch when a fluid flow-imparted force impinging upon said paddle is less than a magnetic force between said cylindrical and flat magnets.

* * * * *